United States Patent [19]

Tanaka et al.

[11] 4,128,823

[45] Dec. 5, 1978

[54] SWITCH

[75] Inventors: Akira Tanaka, Zama; Yuji Hayashi, Suzaka; Makoto Kassai, Yokohama; Toshito Hara, Sagamihara, all of Japan

[73] Assignee: Fujitsu Limited, Japan

[21] Appl. No.: 746,993

[22] Filed: Dec. 2, 1976

[30] Foreign Application Priority Data

Dec. 25, 1975 [JP] Japan ..... 50-153973
Feb. 10, 1976 [JP] Japan ..... 51-12799

[51] Int. Cl.[2] ..... H01H 1/54

[52] U.S. Cl. ..... 335/196; 200/268; 335/153; 335/280

[58] Field of Search ..... 335/196, 153, 280, 302; 200/267, 268

[56] References Cited

U.S. PATENT DOCUMENTS

| | | | |
|---|---|---|---|
| 2,932,703 | 4/1960 | Haberland | 200/268 |
| 3,261,942 | 7/1966 | Wessel | 335/280 |
| 3,535,664 | 10/1970 | Staar | 335/280 |
| 3,677,947 | 7/1972 | Ray et al. | 335/302 |

*Primary Examiner*—Harold Broome
*Attorney, Agent, or Firm*—Staas and Halsey

[57] ABSTRACT

A switch is disclosed comprising two sets of rod-shaped fixed electrodes formed of a magnetic material and one cylindrical moving electrode formed of a permanent magnet, each set of the fixed electrodes being fixed to the respective end of a cylindrical vessel so that the ends of each set of the fixed electrodes face the ends of the other set of the fixed electrodes with the moving electrode capable of reciprocating between the ends of the two sets of fixed electrodes inside the cylindrical vessel. The moving electrode is comprised of at least one adhesive layer of a metal selected from the group consisting of silver, nickel, copper and alloys thereof on the surface of the permanent magnet, and at least one contact layer of a metal selected from the group consisting of rhodium, wolfram, rhenium, ruthenium and alloys thereof, silver-wolfram, gold-chromium on the adhesive layer of metal. At least the permanent magnet of the moving electrode and the adhesive layer of metal are thermally diffused with each other.

23 Claims, 11 Drawing Figures

SWITCH

This invention relates to a switch of the type which comprises two sets of rod-shaped fixed electrodes formed of a magnetic material and one cylindrical moving electrode formed of a permanent magnet. Each set of the fixed electrodes is fixed to the respective end of a cylindrical vessel so that the ends of each set of the fixed electrodes face the ends of the other set of the fixed electrodes with the moving electrode capable of reciprocating between the ends of the two sets of fixed electrodes inside the cylindrical vessel.

Hereinafter, such a switch is referred to as a flying switch.

The attached FIG. 1 is an illustrative sectional view of the main part of a flying switch. Referring to FIG. 1, two sets of fixed electrodes 1,1 and 2,2 are fixed to the respective ends of a cylindrical insulating vessel 4, e.g. a glass tube, so that the ends of each set of the fixed electrodes face the ends of the other set of the fixed electrodes inside said cylindrical insulating vessel. A moving electrode 3 is located between the two sets of fixed electrodes 1,1 and 2,2 so as to be capable of reciprocating therebetween. The fixed electrodes 1,1 and 2,2 are formed of a soft magnetic material, e.g. 52 Ni- 48 Fe alloy, and the moving electrode 3 is formed of a permanent magnet.

In order to actuate the flying switch, each set of fixed electrodes 1,1 and 2,2 is magnetized, for example by coils are shown, in the opposite direction to the other set, so as to induce the same magnetic poles (N,N or S,S) at the facing ends of the fixed electrodes 1,1 and 2,2. The permanent magnet of the moving electrode 3 has its magnetic poles (N, S) on the opposite ends, each of which faces a set of fixed electrodes. The moving electrode 3 is effected at the same time by both attraction and repulsion, and contacts one of the two sets of fixed electrodes 1,1 and 2,2. This results in the closing of an electrical circuit of one set of fixed electrodes 1,1 or 2,2 through the moving electrode 3.

A flying switch does not employ an elastic reed-blade as does the reed switch. Further, the flying switch is capable of switching a larger current at higher voltage, even though it is of a smaller size, because the distance between contacts of the flying switch can be larger than that of the reed switch and the switching force of the former also can be larger than that of the latter.

The moving electrode of a conventional flying switch is composed of a permanent magnet such as a rare earth element-cobalt type magnet coated with a contact layer of metal such as rhodium. However, the permanent magnet is formed by sintering a magnetic powder and is, therefore, difficult to firmly attach to other metals. In addition a sintered magnet, especially a rare earth element-cobalt type magnet, is itself very brittle, although it has an excellent magnetic performance, e.g. high H-B products.

Thus, two very difficult problems are encountered in the conventional flying switch. That is, first, the contact layer of metal is liable to be broken away from the permanent magnet and, second, the permanent magnet is liable to crack or break. These problems lead to reduction in reliability and service life of the flying switch.

It a primary object of the present invention to provide a flying switch in which there is a strong adhesion of the contact layer of metal on the surface of the permanent magnet and with which there is a reduced probability of the contact layer of metal breaking away, and also, of the moving electrode itself cracking and breaking.

This object is accomplished by providing a flying switch wherein the moving electrode comprises at least one adhesive layer of a metal selected from the group consisting of silver, nickel, copper and alloys thereof on the surface of the permanent magnet, and at least one contact layer of a metal selected from the group consisting of rhodium, wolfram, rhenium, ruthenium and alloys thereof, silver-wolfram and gold-chromium on said adhesive layer of metal, and at least said permanent magnet of the moving electrode and said adhesive layer of metal are thermally diffused with each other.

The switch of the present invention is illustrated in detail with reference to the accompanying drawings, in which.

Figure 2:
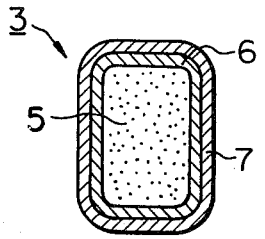
FIG. 2 is a sectional view of the moving electrode of the switch according to the present invention.
Figure 3:
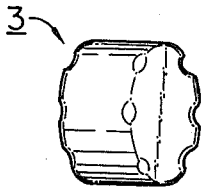
FIG. 3 is a perspective view of a conventional moving electrode of a switch of the prior art, partly broken by the shock of repeated contacts.

Referring to FIG. 2, because the moving electrode 3 of the flying switch has an adhesive layer 6 of metal on the entire surface of the permanent magnet 5 and a contact layer 7 of metal on the entire surface of the adhesive layer 6 of metal, the brittle permanent magnet 5 of the moving electrode 3 is protected from the shock of repeated contacts with the fixed electrodes. Consequently, the probability of the permanent magnet cracking and breaking is reduced and repeated stable contacts of the moving electrode 3 with the fixed electrodes over a long period of time are possible. The adhesive layer 6 is formed of a metal selected from silver, nickel, copper and alloys thereof, and the contact layer 7 is formed of a metal selected from rhodium, wolfram, rhenium, ruthenium and alloys thereof, silver-wolfram and gold-chromium.

In FIG. 2, both the contact layer and the adhesive layer are single layers. However, a plurality of adhesive layers may be piled on top of each other or a plurality of contact layers and adhesive layers may be arranged alternately.

The combination of the metal of the adhesive layer and that of the contact layer may, preferably, be silver-rhodium, nickel-rhodium, copper-rhodium or silver-wolfram. Of these, an optinum combination is silver-rhodium or nickel-rhodium. Both the adhesive layer 6 of metal and the contact layer 7 of metal can be plated electrochemically. However, they may be attached by means of dry coating such as sputtering.

The diffusion of the metals of the adhesive layer 6 and the permanent magnet 5 can be accomplished by heating after the adhesive layer 6 is formed on the permanent magnet 5 but before the contact layer 7 is formed thereon. Alternatively, the moving electrode may be heated, after it is provided with the contact layer 7 on the adhesive layer 6, so as to diffuse both the permanent magnet 5 with the adhesive layer 6 and the adhesive layer 6 with the contact layer 7. This latter method will result in the moving electrode 3 being much stronger than with the former method.

Figure 1:
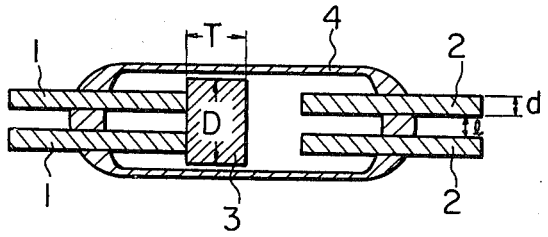
FIG. 1 is an illustrative sectional view of the main part of a flying switch.

As the adhesive layer of metal is formed of silver, nickel or copper, the diffusion can be performed at a temperature in the range of 600° to 750° C. The heat generated by the sputtering of the metallic layers 6 and 7 serves to diffuse the layered metals to a certain extent. Further, the heat generated when the insulating cylindrical vessel 4 (in FIG. 1), e.g. a glass tube, is sealed at 500° to 600° C., promotes metallic diffusion. However, it should be noted that the diffusion temperature of the adhesive layer and the contact layer must not affect the magnetic performance features of the permanent magnet of the moving electrode.

The moving electrode of the switch of the present invention is, preferably, formed of a rare earth element-cobalt type magnet consisting essentially of (1) one or more rare earth elements such as samarium, cerium and praceodymium, and; (2) cobalt or both cobalt and iron. The atomic ratio of (1) the rare earth element to (2) the cobalt component is preferably in the range of 1:5 to 1:8.5. The high coercive force of a rare earth element-cobalt type magnet does not deteriorate even at 800° to 900° C., although it is inferior in brittleness to a platinum-cobalt type magnet. However, the latter magnet is high in cost and its coercive force deteriorates at a relatively low temperature such as 300° C. Further, in the rare earth element-cobalt type magnet, a part of the cobalt component may, preferably, be substituted by both copper and vanadium. The amounts of copper and vanadium to be substituted for a part of the cobalt component are preferably 7 to 19% and 0.5 to 6%, respectively, both by weight based on the total weight of (1) the rare earth element and (2) the cobalt component.

Copper, even in the case when its content is low, is effective to improve the fracture resistance of the above mentioned permanent magnet. However, from the point of view of the coercive force of the permanent magnet, the effective content of copper is limited to the range of 7 to 19% by weight. A vanadium content of less than 0.5% by weight is not effective to prevent the permanent magnet from cracking and a vanadium content of more than 6% by weight reduces its saturation magnetization force.

The rare earth element-cobalt type magnet wherein a part the cobalt component is substituted by both copper and vanadium has an extremely high coercive force, e.g. Hc=4000 Gauss, and a sufficiently high flexural strength, e.g. 18 Kg/mm, to be used as a cast magnet moving electrode.

The flying switch provided with a moving electrode of the present invention has a long service life, as confirmed in the following experiments.

Moving electrodes of types A (comparative), B, $C_1$, $C_2$, $D_3$ and D, as shown in the table below, were formed of a rare earth element-cobalt type permanent magnet, consisting of samarium as the rare earth element R and cobalt, iron, copper and vanadium as the transition elements Tr. The atomic ratio of the element R to the elements Tr was 1:7.6. The contents of copper and vanadium were 12% by weight and 1% by weight, respectively, based on the total weight of the permanent magnet. Each permanent magnet body was of a cylindrical shape which had a diameter of 2.6 mm and a height of 2 mm, and thus, the ratio of height to diameter was 0.77. The permanent magnet body was electrochemically plated with a metal, e.g. silver, nickel or copper, to form an adhesive layer, and then, the metal-plated permanent magnet was heated at 750° C. for an hour so as to diffuse the adhesive layer of metal and the permanent magnet with each other. Then, the heat-treated body was further electrochemically plated or sputtered with rhodium to form a contact layer on the surface. The metal used for the adhesive layer, the thickness of the adhesive layer and the thickness of the rhodium contact layer were as follows.

| | Type | Adhesive layer | Contact layer |
|---|---|---|---|
| A | (Comparative) | none | *Rh 10 microns |
| B | | *Cu 10 microns | *Rh 10 microns |
| C | | | |
| | $C_1$ | *Ni 10 microns | *Rh 3 microns |
| | $C_2$ | *Ni 20 microns | *Rh 3 microns |
| | $C_3$ | *Ni 40 microns | *Rh 3 microns |
| D | | *Ag 10 microns | **Rh 5 microns |

*Electrochemically plated
**Sputtered

Each moving electrode was inserted in a glass cylinder of a 4.0 mm inner diameter in an atmosphere of nitrogen, and both ends of the glass cylinder were heat-sealed while two pairs of rod-shaped fixed electrodes having a 0.6 mm diameter were fixed to the ends of the glass cylinder at a distance of 1.0 mm. An electric current of 100 volts × 1 ampere was applied to one pair of the fixed electrodes and external fields of magnetization were applied, so as to effect repeated contacts between the moving electrode and the fixed electrodes until the switching ceased due to a failure in the switch.

Figure 4:
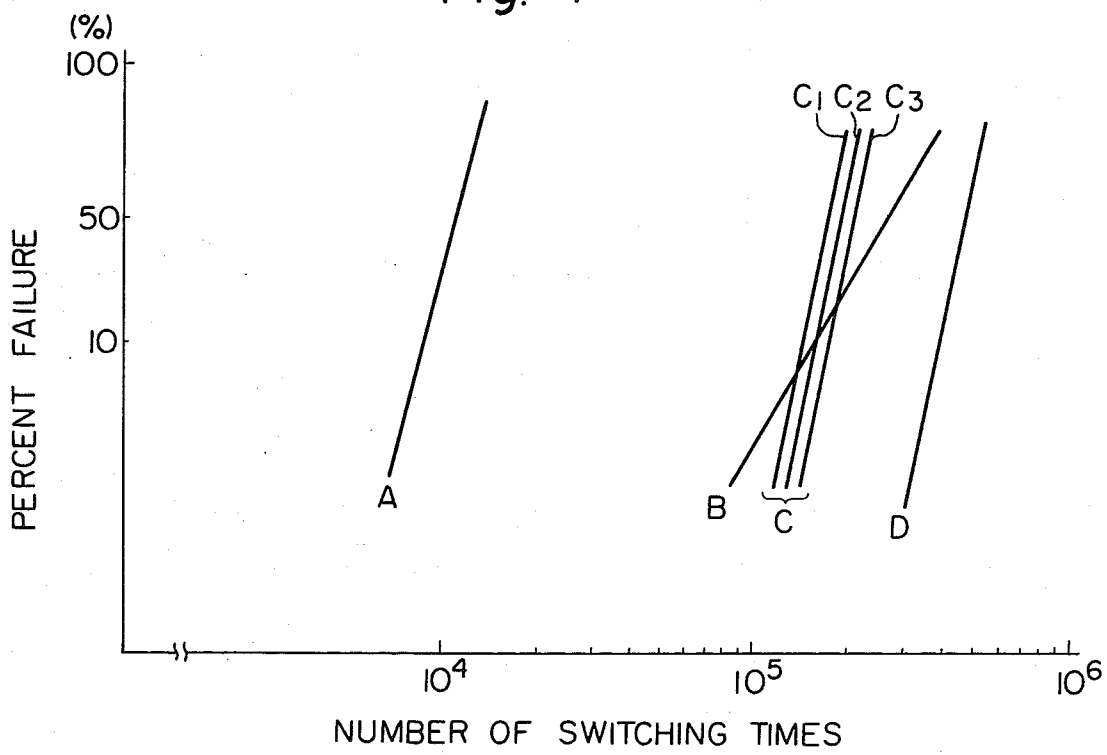
FIG. 4 is a graph showing the relationship between the percent failure and the number of switching times of the switches according to the present invention and those of the prior art.

The results of the above life tests are shown in FIG. 4, wherein the term "percent failure" refers to the percentage of the switches in which the contact layer of metal breaks away or the permanent magnet breaks, so that the consequently increased contact resistance between the moving electrode and the fixed electrodes leads to bonding therebetween by fusion, or broken particles inserted between the rod-shaped fixed electrodes lead to a shortcircuit therebetween. From FIG. 4, it will be understood that the switch of the present invention has more than ten times as long a service life as the switches of the prior art.

Although, in the above experiments, the adhesive layer was formed of silver, nickel or copper and the contact layer was formed of rhodium, similar results are obtained when other metals are used. The suitable metals used for the contact layer include rhodium, wolfram, rhenium, ruthnium and alloys of these elements. Also suitable are alloys such as silver-wolfram and gold-chromium. The suitable metals used for the adhesive layer include silver, nickel, copper and alloys of these elements.

In order to operate the flying switch normally, the permanent magnet of the moving electrode must not crack or break during operation. Further, the moving electrode must not fail to hold contact with the fixed electrodes, even if an undesirable external impact force $F_G$ is applied to the moving electrode in the opposite direction to the attractive force $F_a$. The attractive force $F_a$ used herein means that with which the moving electrode 3 formed of a permanent magnet contacts the fixed electrodes 4 formed of a soft magnetic material. The larger the difference between the attractive force $F_a$ and the external impact force $F_G$, the better the contact between the moving electrode and the fixed electrode. It now has been found that, in order to obtain an optimum value of the force difference $F_a$-$F_G$, the moving electrode should be of a cylindrical shape having a certain ratio of height to diameter.

The moving electrode of the switch according to the present invention may have the ratio of height T to diameter D, preferably, in the range of 0.3 to 1.0, and, more preferably, in the range of 0.6 to 0.9. Such desired ratios of height T to diameter D of the cylindrical moving electrode have been derived from the experiments described below, wherein cylindrical moving electrodes of various proportional sizes were prepared and tested for their attractive force $F_a$ and the external impact force $F_G$ was compared to the attractive force $F_a$.

Each moving electrode was formed of a permanent magnet of the same composition as used in the experiments with regard to the life tests illustrated with reference to FIG. 4. However, the moving electrodes were provided with neither the adhesive layer of metal nor the contact layer of metal for convenience. The size of the moving electrode was varied in the experiments.

One pair of rod-shaped fixed electrodes each having a diameter of 1.5 mm was set so that the two fixed electrodes were disposed in parallel and separated from each other by a distance of 0.3 mm. Using this pair of fixed electrodes and the above-mentioned moving electrode, the attractive force $F_a$ was determined and the external impact force $F_G$ to be applied to the moving electrode was computed as follows.

The attractive force $F_a$ was determined by measuring the force required to remove the contacted moving electrode from the fixed electrodes by means of a tension tester. The external impact force $F_G$ was computed based on the following equation, according to U.S. MIL STD 202 E.

$$F_G = m(1 + H)g = (1 + H)\rho \frac{\pi}{4} D^2 T g$$

where

*m*: mass of moving electrode;
H: external impact value;
*g*: acceleration of gravity;
$\rho$: density of moving electrode;
D: diameter of moving electrode;
T: thickness of moving electrode.

Figure 5:
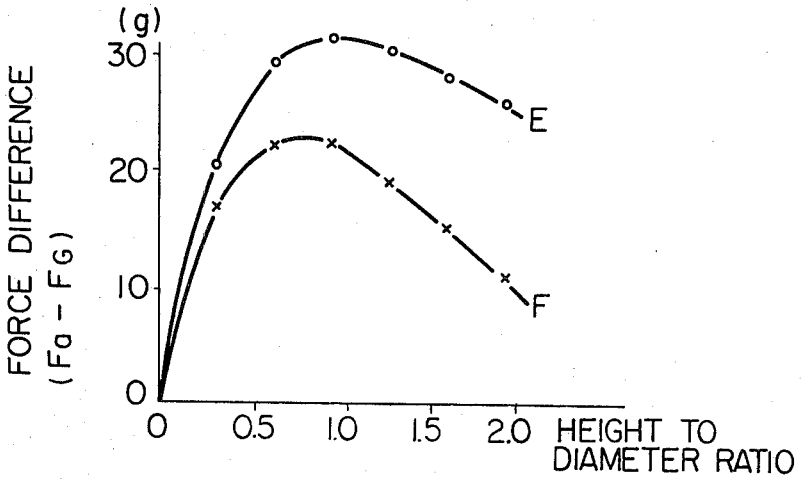
FIG. 5 is a graph showing the relationship between the force difference (attractive-external impact) and the size ratio (height to diameter) of the moving electrode.
Figure 6:
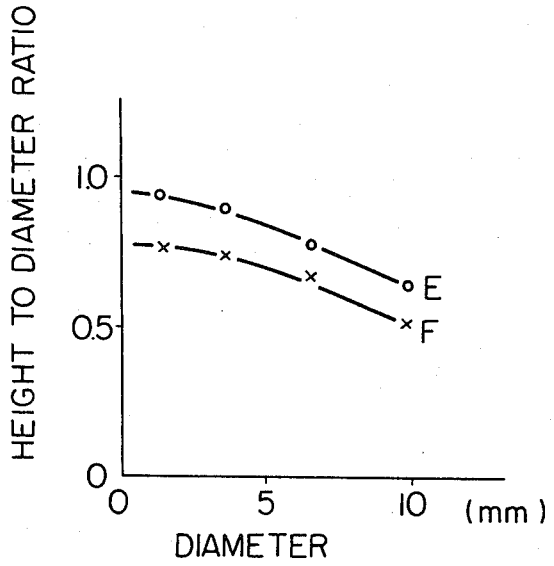
FIG. 6 is a graph showing the relationship between the diameter and the size ratio at which the force difference of the moving electrode is maximum.

The test results are shown in FIG. 5, wherein lines E and F show the relationship between the force differences $F_a$-$F_G$ and the ratios of height T to diameter D of the cylindrical moving electrodes, and in FIG. 6, wherein line E and line F refer to the cases in which H was 50G and 100G, respectively. In the test shown in FIG. 5, the diameter of the moving electrode was set at 3.3 mm.

Referring to FIG. 5, the force difference of line E (H=50G) becomes maximum at the ratio of height T to diameter D of 0.91. On the other hand, the force difference of line F (H=100G) becomes maximum at the ratio of height T to diameter D of 0.73.

Referring to FIG. 6, the ratios of height to diameter, at which the force differences are maximum, vary depending upon the diameter as plotted in line E (H=50G) and in line F (H=100G).

The practically acceptable minimum ratio of height to diameter was determined on moving electrodes with various ratios of height T to diameter D as follows. Each moving electrode was held about 5 mm above a pair of fixed electrodes which were arranged upright and not actuated by an exciting force. The moving electrode was dropped on the ends of the fixed electrodes, being propelled downward by the force of gravity and its magnetic force. The results are shown in FIG. 7, wherein crosses and dots show that the moving electrodes were broken before being dropped about one hundred times and not broken when dropped about one hundred times, respectively.

Figure 7:
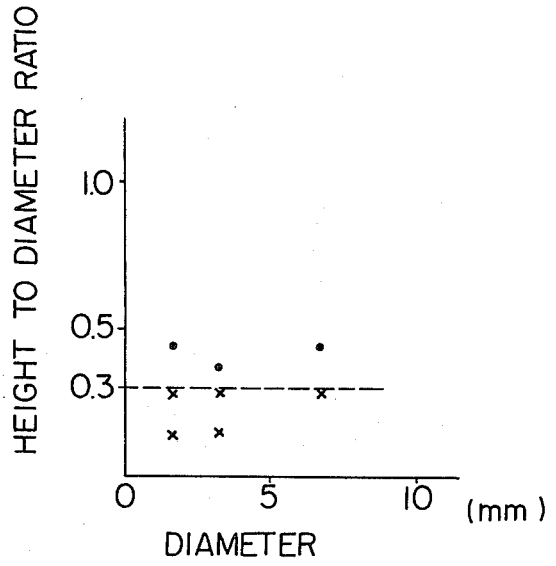
FIG. 7 is a graph showing the relationship between the diameter and the size ratio at which the moving electrode cracked or broke.

Considering the results shown in FIG. 6 and FIG. 7, the ratio of height T to diameter D should preferably be in the range of 0.3 to 1.0, more preferably, in the range of 0.6 to 0.9.

Each set of fixed electrodes of the flying switch of the present invention can be composed of more than two rods formed of a magnetic material. However, each set may, conveniently, comprise a pair of rod-shaped electrodes, as shown in FIG. 8A.

Figure 8A:
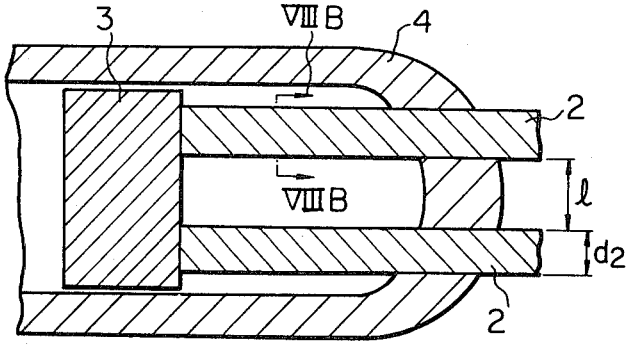
FIG. 8A is a sectional view of the switch according to the invention.
Figure 8B:
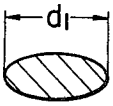
FIG. 8B is an elliptical cross section of the fixed electrodes taken along line VIIIB-VIIIB in FIG. 8A.

Referring to FIGS. 8A and 8B, the cross sections of the fixed electrodes may, preferably, be shaped as elongated circles, such as ellipses and the like. The pair of electrodes 2,2 of elongated circle cross sections is fixed to one end of the cylindrical vessel 4, preferably, in a way such that the major diameter $d_1$ of each elongated circle is parallel to the other and perpendicular to the imaginary plane involving the two axes of the pair of fixed electrodes 2,2. The ratio of the length of the major diameter $d_1$ to that of the minor diameter $d_2$ may, preferably, be about 2:1. Such fixed electrodes with elongated circle cross sections are capable of supporting the cylindrical moving electrode more stably than the conventional round cross sectioned fixed electrodes.

Figure 9:
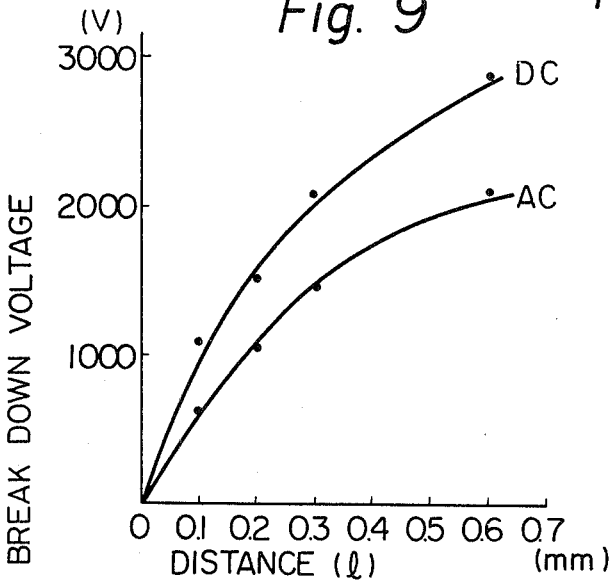
FIG. 9 is a graph showing the relationship between the breakdown voltage and the distance between two fixed electrodes of one pair of fixed electrodes shown in FIG. 8.

When the cross sectional areas of the fixed electrodes 2,2 as described above are the same as those of the conventional round rods and the distance between the axes of the pair of fixed electrodes 2,2 is the same, the distance between the two fixed electrodes 2,2 in one pair becomes longer than that between the conventional round sectioned fixed electrodes. For example, when the distance between two conventional round sectioned fixed electrodes in one pair is 0.4 mm, it would be 0.6 mm in the case of the fixed electrodes with elongated circle cross sections, provided that the switching capacity is the same. In general, the breakdown voltage obtained between a pair of fixed electrodes increases both in D.C. and A.C. with an increase in the distance therebetween as shown in FIG. 9. Therefore, as seen from FIG. 9, the switch provided with such elongated circle cross sectioned fixed electrodes disposed at a distance of 0.6 mm exhibits breakdown voltages of about 2,000 V A.C. and about 2,700 V D.C., whereas the conventional switch provided with round sectioned fixed electrodes disposed at a distance of 0.4 mm exhibits breakdown voltages of about 1,800 V A.C. and about 2,300 V D.C.

Figure 10:
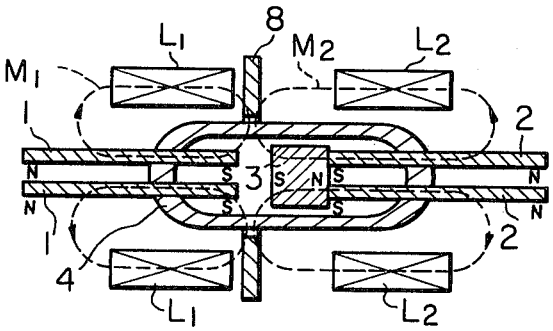
FIG. 10 is an illustrative sectional view of the switch according to the present invention.

Although the main part of the switch of the present invention is described above, the entire assembly of the switch of the present invention will now be briefly described with reference to FIG. 10, which shows one example of the switch of the present invention. Referring to FIG. 10, a magnetic shunt ring plate 8, formed of a soft magnetic material, is arranged movably in the space around the enclosing glass tube and between excitation coils $L_1$ and $L_2$. When the excitation coils $L_1$ and $L_2$ are excited in one direction, i.e., the direction shown by arrows in FIG. 10, the magnetic shunt ring plate 8 is located at a certain location by the action of the magnetic force and, then, each of magnetic circuits $M_1$ and $M_2$ is closed. On the other hand, when the excitation coils $L_1$ and $L_2$ are excited in the opposite direction, the moving electrode 3 is brought into contact with the fixed electrodes 1,1, i.e., not with the fixed electrodes 2,2, so that the magnetic shunt ring plate 8 is moved nearer the excitation coil $L_2$. Although the two closed magnetic circuits $M_1$ and $M_2$ temporarily have different boundarys, due to the different locations of the moving electrode, it is possible to prevent the two magnetic fluxes from interferring with each other.

What we claim is:

1. A switch comprising two sets of rod-shaped fixed electrodes formed of a magnetic material and one cylindrical moving electrode formed of a permanent magnet, each set of the fixed electrodes being fixed to the respective end of a cylindrical vessel so that the ends of each set of the fixed electrodes face the ends of the other set of the fixed electrodes with the moving electrode capable of reciprocating between the ends of the two sets of fixed electrodes inside the cylindrical vessel, wherein said moving electrode is formed of a rare earth element-cobalt type permanent magnet which comprises at least one adhesive layer of a metal selected from the group consisting of silver, nickel, copper and alloys thereof on the surface of said permanent magnet, and at least one contact layer of a metal selected from the group consisting of rhodium, wolfram, rhenium, ruthenium and alloys thereof, silver-wolfram and gold-chromium on said adhesive layer of metal, and at least said permanent magnet and said adhesive layer of metal are thermally diffused to each other.

2. A switch as claimed in claim 1, wherein said adhesive layer of metal is formed of silver.

3. A switch as claimed in claim 1, wherein said adhesive layer of metal is formed of nickel.

4. A switch as claimed in claim 1, wherein said adhesive layer of metal is formed of copper.

5. A switch as claimed in claim 1, wherein said adhesive layer of metal is formed of a silver-nickel alloy.

6. A switch as claimed in claim 1, wherein said adhesive layer of metal is formed of a silver-copper alloy.

7. A switch as claimed in claim 1, wherein said adhesive layer of metal is formed of a nickel-copper alloy.

8. A switch as claimed in claim 1, wherein said contact layer of metal is formed of rhodium.

9. A switch as claimed in claim 1, wherein said contact layer of metal is formed of wolfram.

10. A switch as claimed in claim 1, wherein said contact layer of metal is formed of a silver-wolfram alloy.

11. A switch as claimed in claim 1, wherein said moving electrode is formed of a rare earth element-cobalt type permanent magnet consisting essentially of (1) at least one rare earth element selected from the group consisting of samarium, cerium and praceodymium and (2) cobalt or both cobalt and iron, the ratio of the member of (1) rare earth element atoms to (2) cobalt or both cobalt and iron atoms in the range of 1:5 to 1:8.5.

12. A switch as claimed in claim 11, wherein 0.5 to 6% by weight of vanadium and 7 to 19% by weight of copper, based on the total weight of (1) the rare earth element and (2) the cobalt or both cobalt and iron, are substituted for a part of the cobalt or both cobalt and iron.

13. A switch as claimed in claim 11, wherein said rare earth element is samarium.

14. A switch as claimed in claim 1, wherein the ratio of height to diameter of the cylindrical moving electrode is in the range of 0.3 to 1.0.

15. A switch as claimed in claim 1, wherein the cross sections of the fixed electrodes arranged in pairs are shaped as elongated circles, of which the major diameters are parallel to each other and are perpendicular to the imaginary plane involving the two axes of the fixed electrodes in one pair.

16. A switch as claimed in claim 1, wherein the moving electrode is actuated by the magnetic force of excitation coils which are disposed around the cylindrical vessel and excited by electrical pulses, and a magnetic shunt ring plate formed of a soft magnetic material is arranged movably in the space around the enclosing cylindrical vessel and between the excitation coils.

17. A switch as claimed in claim 1, wherein said moving electrode comprises a rare earth element-cobalt type permanent magnet consisting essentially of at least one rare earth element selected from the group consisting of samarium, cerium, and praceodymium, a metal selected from the group consisting of cobalt and both cobalt and iron, 0.5 to 6% by weight of vanadium, and 7 to 19% by weight of copper, the percentages of vanadium and copper being based on the total weight of the rare earth element and the metal selected from the group consisting of cobalt and both cobalt and iron, and the ratio of the atoms of rare earth element to the atoms of vanadium, copper, and metal selected from the group consisting of cobalt and cobalt and iron being in the range of 1:5 to 1:8.5.

18. A switch, comprising:

an elongated vessel having two ends;

two sets of end electrodes, one of said sets being mounted at each of the ends of said vessel;

a permanently magnetized elongated electrode consisting essentially of at least one rare earth element selected from the group consisting of samarium, cerium, and praceodymium, and a metal selected from the group consisting of cobalt and both cobalt and iron, said elongated electrode being a cylinder having a ratio of to diameter in the range of 0.3 to 1.0, being contained within said vessel, and being linearly movable between said pairs of height end electrodes;

at least one adhesive layer affixed to said elongated electrode, each of said at least one adhesive layers being a metal selected from the group consisting of silver, nickel, copper, and alloys of these metals, at least one of said at least one adhesive layers being thermally diffused; and at least one contact layer affixed to said elongated electrode, each of said at least one contact layers being a metal selected from the group consisting of rhodium, wolfram, rhenium, ruthenium, allows of these metals, silver-wolfram, and gold-chromium.

19. The switch of claim 18, wherein the ratio of atoms of said at least one rare earth element to the atoms of said metal selected from the group consisting of cobalt and both cobalt and iron is 1:5 to 1:8.5.

20. The switch of claim 18, wherein said elongated electrode consists essentially of vanadium, copper, at least one rare earth element selected from the group consisting of samarium, cerium, and praceodymium, and a metal selected from the group consisting of cobalt and both cobalt and iron.

21. The switch of claim 20, wherein the vanadium content ranges from 0.5% to 6%, the copper content ranges from 7% to 19%, said percentages being based on the total weight of said at least one rare earth element and said metal selected from the group consisting of cobalt and both cobalt and iron, and the ratio of atoms of said at least one rare earth element to the atoms of said vanadium, copper, and metal selected from the group consisting of cobalt and both cobalt and iron being in the range of 1:5 to 1:8.5.

22. The switch of claim 18, further comprising means for moving said elongated electrode.

23. The switch of claim 18, wherein each of said end electrodes is an elongated circle in cross-section.

* * * * *

UNITED STATES PATENT AND TRADEMARK OFFICE

CERTIFICATE OF CORRECTION

PATENT NO. : 4,128,823

DATED : December 5, 1978

INVENTOR(S) : Akira Tanaka et al

It is certified that error appears in the above-identified patent and that said Letters Patent are hereby corrected as shown below:

Column 1, line 31, "are" should be --not--.
Column 1, line 66, after "It" insert --is--.
Column 3, line 6, "optinum" should be --optimum--.
Column 4, line 7, "$D_3$" should be --$C_3$--.
Column 4, line 68, "ruthnium" should be --ruthenium--.
Column 7, line 23, "boundarys" should be --boundaries--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*